United States Patent [19]

Ohno et al.

[11] Patent Number: 4,976,791

[45] Date of Patent: Dec. 11, 1990

[54] HEAT RESISTANT SINGLE CRYSTAL NICKEL-BASE SUPER ALLOY

[75] Inventors: Takehiro Ohno; Rikizo Watanabe, both of Yasugi, Japan

[73] Assignee: Hitachi Metals, Ltd., Japan

[21] Appl. No.: 469,740

[22] Filed: Jan. 19, 1990

Related U.S. Application Data

[63] Continuation of Ser. No. 349,210, May 9, 1989, abandoned.

[30] Foreign Application Priority Data

May 17, 1988 [JP] Japan ..... 63-120023
Feb. 9, 1989 [JP] Japan ..... 1-30172

[51] Int. Cl.[5] ..... C22C 19/05
[52] U.S. Cl. ..... 148/404; 148/410
[58] Field of Search ..... 148/404, 410, 428; 420/445

[56] References Cited

U.S. PATENT DOCUMENTS 4,116,723 9/1978 Gell et al. .
4,209,348 6/1980 Duhl et al. .
4,222,794 9/1980 Schweizer et al. .
4,402,772 9/1983 Duhl et al. .

FOREIGN PATENT DOCUMENTS 0063511 10/1982 European Pat. Off. .
57-89451 6/1982 Japan .
59-190342 10/1984 Japan .
62-116748 5/1987 Japan .
62-290839 12/1987 Japan .
1557900 12/1979 United Kingdom .
2159174A 11/1985 United Kingdom .

*Primary Examiner*—R. Dean
*Attorney, Agent, or Firm*—Finnegan, Henderson, Farabow, Garrett & Dunner

[57] ABSTRACT

This invention relates to a heat resistant single-crystal nickel-base super alloy that possesses microstructural stability and excellent creep rupture strength and oxidation resistance. This alloy is composed of 4–9% chromium, 4–6.5% aluminum, 5–8.5% wolfram, 5–8.5% tantalum, 3–6% molybdenum, 0.01–0.30% hafnium, 0.02–4% cobalt by weight, and the balance of nickel and incidental elements and meets the conditional expression wolfram+tantalum<16%. The preferable chemcial composition of this alloy is approximately 6.4% chromium, approximately 5.1% aluminum, approximately 7.3% wolfram, 7.3% tantalum, approximately 4.3% molybdenum, approximately 0.1% hafnium, approximately 1% cobalt by weight, and the balance of nickel and incidental elements.

6 Claims, No Drawings

HEAT RESISTANT SINGLE CRYSTAL NICKEL-BASE SUPER ALLOY

This application is a continuation of application Ser. No. 07/349,210, filed May 9, 1989, now abandoned.

FIELD OF THE INVENTION

This invention relates to a heat resistant single-crystal nickel-base super alloy that has excellent creep rupture strength and oxidation resistance. This alloy is mainly applied to gas turbine engine blades.

BACKGROUND OF THE PRESENT INVENTION

It is known that the rupture in metals at high temperatures occurs at the grain boundaries. It is also known that if a turbine blade is formed of a metal which has a single-crystal structure with no grain boundary and which is subjected to appropriate heat treatment, the creep rupture strength of this blade at high temperatures is remarkably improved. On the basis of this recognition, United Technologies Corporation proposed Alloy 444 (disclosed in the U.S. Pat. No. 4,116,723), Alloy 454 (disclosed in the U.S. Pat. No. 4,209,348) and Alloy 203E (disclosed in the U.S. Pat. No. 4,222,794), Air Research Corporation proposed NASAIR 100, and Canon Muskegon Corporation proposed CMSX-2 (disclosed in the Japanese Pat. Unexamined Publication No. 57-89451) and CMSX-3 (disclosed in the Japanese Pat. Unexamined Publication No. 59-190342). All of these alloys are heat resistant nickel-base super alloys only for single crystals.

In addition to them, heat resistant single-crystal nickel-base super alloys are also proposed in the British Pat. No. 1,557,900, British Pat. No. 2,159,174A, European Pat. No. 0063511Al, U.S. Pat. No. 4,402,772, etc.

The above-mentioned single-crystal alloys have by far superior creep rupture strength to ordinary polycrystal alloys. In practical applications, however, the development of alloys that provide higher creep rupture strength and excellent oxidation resistance is desired for the purpose of improving the efficiency of gas turbine engines; providing that the use of very expensive alloying elements, such as rhenium, is not desirable for the development of these alloys.

Conventionally, the improvement of the creep rupture strength of a single-crystal alloy depends mainly on an increase in the amounts of added wolfram tungsten, and tantalum as alloying elements. Unfavorable phenomena such as precipitation of detrimental phases occur if the added amounts are too large. These unfavorable phenomena make it difficult to develop alloys with high creep rupture strength. For example, Alloy 444, Alloy 454, etc. which were developed formerly do not provide sufficiently high creep rupture strength. Alloy 203E and the alloy disclosed in the British Pat. No. 1,557,900 contain rhenium which is an expensive alloying element. NASAIR 100 was developed to improve the creep rupture strength. It was found that in the case of this alloy, detrimental phases, such as $\alpha$-wolfram phase and $\mu$-phase, precipitate due to high wolfram contents, resulting in a decrease in the creep rupture strength. Similarly, it seems that the $\alpha$-wolfram phase, etc., precipitate due to high wolfram and tantalum contents in the alloy described in the British Pat. No. 2,159,174A. To prevent the precipitation of detrimental phases, such as $\alpha$-wolfram phase, it is necessary to reduce the amounts of added wolfram, molybdenum, tantalum, etc. If, however, these added amounts are excessively reduced, the creep rupture strength decreases. CMSX-2 and CMSX-3 are alloys developed to prevent the precipitation of the $\alpha$-wolfram phase, $\mu$-phase, etc. and to obtain a stable microstructure. However, the creep rupture strength of these alloys is not sufficiently high. The creep rupture strength of the alloys disclosed in the European Pat. No. 0063511A1 and U.S. Pat. No. 4,402,772 is not sufficiently high, either.

Turbine blades are parts subjected to high temperatures and oxidation resistance is one of the important properties that turbine blades are required to provide. In general, oxidation resistance is improved by increasing the amounts of alloying elements, such as chromium and aluminum. To stabilize the alloy microstructure and obtain high creep rupture strength, however, the amounts of chromium and aluminum are limited to narrow ranges. For this reason, it is not easy to obtain good oxidation resistance.

To develop an alloy that possesses microstructural stability and excellent creep rupture strength without using expensive alloying elements such as rhenium, the inventors of the present invention examined the amount of each alloying element added and the composition balance of the alloying elements. As a result, following alloy was discovered: a single-crystal nickel-base heat-resisting superalloy being composed of 4–10% chromium, 4–6.5% aluminum, 4–10% wolfram, 4–9% tantalum, 1.5–6% molybdenum by weight and the balance of nickel and incidental elements and satisfying the conditional expression $W/2+Ta/2+Mo=9.5-13.5\%$, as disclosed in the Japanese Pat. Unexamined Publication No. 62-116748. The inventors also discovered an alloy obtained by adding not more than 12% cobalt to this alloy (disclosed in the Japanese Pat. Unexamined Publication No. 62-290839) as an alloy in which the creep rupture strength of this alloy is further improved. These alloys that are excellent in the creep rupture ductility and stability of the micro structure will be able to extend the life of gas turbine engine blades if their oxidation resistance is further improved.

BRIEF SUMMARY OF THE INVENTION

Therefore, the object of the present invention is to supply a heat resistant single-crystal nickel-base super alloy that possesses microstructural stability, excellent creep rupture strength and oxidation resistance. According to one feature of the invention, the heat resistant single-crystal nickel-base super alloy is composed of 4–9% chromium, 4–6.5% aluminum, 5–8.5% wolfram, 5–8.5% tantalum, 3–6% molybdenum, 0.01–0.30% hafnium, 0.01–4% cobalt by weight and the balance of nickel and incidental elements and satisfies the condition that the total amount of wolfram and tantalum should be less than 16%. According to another feature of the invention, the heat resistant single-crystal nickel-base super alloy is composed of 4.5–8.5% chromium, 4–6% aluminum, 5.5–8.2% wolfram, 5.5–8.2% tantalum, 3.5–5.5% molybdenum, 0.05–0.25% hafnium, 0.5–3% cobalt by weight and the balance nickel and incidental elements and satisfies the condition that the total amount of wolfram and tantalum should be less than 16%. According to a further feature of the invention, the heat resistant single-crystal nickel-base super alloy is composed of approximately 6.4% chromium, approximately 5.1% aluminum, approximately 7.3% wolfram, 7.3% tantalum, approximately 4.3% molybdenum, approximately 0.1% hafnium, approximately 1% cobalt by weight and the balance of nickel and incidental elements.

The alloy of the present invention contains carefully controlled amounts of hafnium and cobalt, provides the creep rupture strength and microstructural stability of the levels achieved in the alloy disclosed in the above-mentioned Japanese Pat. Unexamined Publication No. 62-290839, and has remarkably improved oxidation resistance. Therefore, the alloy of the present invention is suitably applied to gas turbine blades, contributing greatly to the improvement of the efficiency of gas turbines.

DETAILED DESCRIPTION OF THE INVENTION

As mentioned above, the nickel base alloy of the present invention contains chromium, wolfram, tantalum, molybdenum hafnium and cobalt. The amounts of these alloying elements added were determined for the following reasons:

Chromium improves the oxidation resistance and corrosion resistance of alloys. Excessive addition of chromium generates detrimental precipitation phases, such as $\sigma$-phase, and lowers the creep rupture strength. The content range of this element is limited to 4–9%. The desirable chromium content range is 4.5–8.5% and the desirable chromium content is approximately 6.4%.

Aluminum is a principal element that serves to precipitation harden heat resistant nickel-base alloys by forming an intermetallic compound called the $\gamma'$-phase. The $\gamma'$-phase is expressed by the basic composition $Ni_3Al$ and is further hardened by the solution of such elements as titanium, tantalum, wolfram and molybdenum. The functions of these elements will be detailed later. Usually, a single-crystal alloy contains a large amount of $\gamma'$-phase (not less than 50% by volume) and a coarse $\gamma'$-phase called the eutectic $\gamma'$-phase exists when the solidification of the alloy melt is completed. This coarse $\gamma'$-phase is detrimental; therefore, solution heat treatment is conducted at high temperatures to dissolve this coarse $\gamma'$-phase in the matrix called the $\gamma$-phase The $\gamma'$-phase that has dissolved by the solution heat treatment precipitates uniformly and finely during cooling and by the aging thereafter, whereby the alloy is hardened. The amount of generated $\gamma'$-phase is not sufficient when the aluminum content is less than 4%. When the aluminum content exceeds 6.5%, the amount of generated $\gamma'$-phase is too large and the eutectic $\gamma'$-phase cannot be completely dissolved by solution heat treatment, with the result that the creep rupture strength decreases. Therefore, the aluminum content range is limited to 4–6.5%. The desirable aluminum content range is 4–6% and the preferable aluminum content is approximately 5.1%.

Wolfram is an element that hardens the $\gamma$-phase and $\gamma'$-phase by dissolving in them. The required wolfram content is at least 5%. However, if the amount of added wolfram is too large, a phase called the $\alpha$-wolfram phase precipitates, lowering the creep rupture strength. Therefore, the wolfram content range is limited to 5–8.5%. The desirable wolfram content range is 5.5–8.2% and the preferably wolfram content is approximately 7.3%.

Tantalum dissolves mainly in the $\gamma'$-phase and hardens this phase. The minimum amount of added tantalum is 5%. If the added amount is too large, the solution treatment of the eutectic $\gamma'$-phase is difficult and the mismatch of the lattice constants between the $\gamma$-phase and the $\gamma'$-phase increases. As a result, the $\gamma'$-phase coarsens, lowering the creep rupture strength. Therefore, the tantalum content range is limited to 5–8.5%. The desirable tantalum content range is 5.5–8.2% and the preferable tantalum content is approximately 7.3%. If the total amount of added wolfram and tantalum is 16% or more, the $\alpha$-wolfram phase is apt to precipitate, with the result that the creep rupture strength decreases and oxidation resistance worsens. Therefore, the total amount of these two elements is limited to less than 16%.

Molybdenum dissolves mainly in the $\gamma$-phase and hardens it although this element dissolves partly in the $\gamma'$-phase. For this reason, the minimum molybdenum content is 3%. However, if molybdenum is added excessively, the $\alpha$-molybdenum phase is generated and the creep rupture strength decreases. Therefore, the molybdenum content range is limited to 3–6%. The desirable molybdenum content range is 3.5–5.5% and the preferable molybdenum content is approximately 4.3%.

Because the above-mentioned three elements have different hardening effects, it is necessary to add all of these elements. Because the wolfram content of the above-mentioned alloy NASAIR 100 is as high as 10.5%, the precipitation of the $\alpha$-wolfram phase is observed. In the alloys CMSX-2 and CMSX-3 obtained by improving this alloy, the wolfram contents are low and the tantalum contents are increased, whereby the precipitation of the $\alpha$-wolfram phase is suppressed. However, since the molybdenum contents of these alloys are low, solid solution hardening is not sufficient. Similarly, the alloys described in the European Pat. No. 0063511A1 and the U.S. Pat. No. 4,402,772 have molybdenum contents lower than that of the alloy of the present invention and solid solution hardening is not sufficient. In the alloy described in the British Pat. No. 2,159,174A, the precipitation of the $\alpha$-wolfram phase is feared because the total amount of added wolfram and tantalum is more than 16%.

Among the three elements of wolfram, tantalum and molybdenum, the amount of added molybdenum is especially larger in the alloys of the present invention than in the conventional alloys. As a result of a detailed examination into the amounts of added elements, they are so designed as to ensure that the solid solution hardening of alloys by the $\gamma$-phase and $\gamma'$-phase takes place to the greatest extent so long as detrimental phases, such as $\alpha$-wolfram phase and $\alpha$-molybdenum phase, are not generated.

For example, in the single-crystal alloy disclosed in the U.S. Pat. No. 4,116,723, the addition of hafnium is considered unnecessary. In the present invention, however, hafnium is an important element for improving oxidation resistance and should be positively added. It was found that oxidation resistance can be substantially improved by the addition of an appropriate amount of hafnium without a substantial deterioration in the creep rupture characteristic. The minimum hafnium content required for obtaining this effect of addition is 0.01%. However, if the amount of added hafnium is too large, the melting point of an alloy decreases and it is impossible to obtain sufficiently high solution heat treatment temperatures, with the result that the dissolution of the eutectic $\gamma'$-phase is difficult. In addition, the alloy microstructure becomes unstable and the creep rupture strength decreases. Therefore, the hafnium content range is limited to 0.01–0.30%. The desirable hafnium content range is 0.05–0.25% and the preferable hafnium content is approximately 0.1%.

According to the U.S. Pat. No. 4,116,723 (Alloy 444), cobalt is apt to form a detrimental phase called the TCP phase and, therefore, its content is held below the levels of impurity elements. It was found, however, that if the amount of added cobalt is appropriate and those of other alloying elements are carefully controlled, the formation of the TCP phase is prevented and oxidation resistance is further improved in the presence of hafnium. In the alloys of the present invention, therefore, the coexistence of cobalt and hafnium is required and the amount of added cobalt is 0.01% or more. However, if the amount of added cobalt exceeds 4%, oxidation resistance worsens. Therefore, the cobalt content is limited to 4% or less. The desirable cobalt content range is 0.5–3% and the preferable cobalt content is approximately 1%. Incidentally, the above-mentioned alloy CMSX-3 is obtained by adding a small amount of hafnium to the alloy CMSX-2; CMSX-3, however, does not provide sufficient oxidation resistance because the amount of added cobalt is more than 4%. Similarly, the oxidation resistance of the alloy described in the U.S. Pat. No. 4,402,772 will be insufficient because of the cobalt content of more than 4% although hafnium is added to this alloy.

Titanium is added to many conventional single-crystal alloys. Titanium dissolves in the $\gamma'$-phase and contributes to the formation of the $\gamma'$-phase and to solid solution hardening of the $\gamma'$-phase. However, because titanium is apt to form the eutectic $\gamma'$-phase and lowers the melting point of an alloy, it is impossible to obtain sufficiently high solution heat treatment temperatures and it is difficult to dissolve the eutectic $\gamma'$-phase. Accordingly, titanium is not added to the alloys of the present invention.

Elements, such as carbon, boron and zirconium, lower the initial melting point in the alloys of the present invention as with other single-crystal alloys. For this reason, the amounts of these elements should be held to the levels of impurity elements.

DESCRIPTION OF EXAMPLES

Table 1 gives results of measurement of the chemical compositions, creep rupture time (with test conditions), and oxidation losses in weight after ten cycles of heating at 1,100°C. for 16 hours made for the samples of alloys of the present invention, comparative alloys and conventional alloys.

For the single-crystal samples, the following heat treatments suited to each alloy were carried out:

t501 ① Heat treatment of the alloys of the present invention and the comparative alloys: Heating at 1,310–1,345°C. for 4 hrs. → air cooling → heating at 1,080°C. for 5 hrs. → air cooling → heating at 870°C. for 20 hrs. → air cooling ② Heat treatment of the conventional alloy NASAIR 100: Heating at 1,320°C. for 4 hrs. → air cooling → heating at 980°C. for 5 hrs. → air cooling → heating at 870°C. for 20 hrs. → air cooling ③ Heat treatment of the conventional alloy CMSX-2: Heating at 1,316°C. for 4 hrs. → air cooling → heating at 980°C. for 5 hrs. → air cooling → heating at 870°C. for 20 → air cooling ④ Heat treatment of the conventional alloy CMSX-3: Heating at 1,302°C. for 4 hrs. → air cooling → heating at 980°C. for 5 hrs. → air cooling → heating at 870°C. for 20 hrs. → air cooling

TABLE 1

| Sample Alloy | | Chemical Composition (Wt %) | | | | | | | | | | |
|---|---|---|---|---|---|---|---|---|---|---|---|---|
| | | Cr | Al | W | Ta | Mo | Ti | Co | Hf | Nb | Ni | W + Ta |
| Alloy of The Present Invention | 1 | 6.7 | 5.0 | 7.3 | 7.0 | 4.4 | — | 0.01 | 0.10 | — | Bal | 14.3 |
| | 2 | 7.0 | 5.4 | 8.0 | 6.8 | 5.2 | — | 0.6 | 0.07 | — | Bal | 14.8 |
| | 3 | 6.5 | 4.8 | 7.3 | 7.3 | 4.4 | — | 0.1 | 0.10 | — | Bal | 14.6 |
| | 4 | 6.3 | 4.9 | 7.3 | 7.5 | 4.4 | — | 1.0 | 0.10 | — | Bal | 14.8 |
| | 5 | 6.3 | 5.0 | 7.4 | 7.6 | 4.3 | — | 1.1 | 0.09 | — | Bal | 15.0 |
| | 6 | 6.3 | 4.8 | 7.3 | 7.2 | 4.4 | — | 1.0 | 0.21 | — | Bal | 14.5 |
| | 7 | 6.2 | 4.8 | 7.5 | 7.5 | 4.5 | — | 2.0 | 0.10 | — | Bal | 15.0 |
| | 8 | 6.1 | 5.2 | 7.2 | 7.3 | 4.3 | — | 3.4 | 0.11 | — | Bal | 14.5 |
| Comparative alloy | 11 | 6.8 | 5.0 | 7.0 | 7.4 | 4.3 | — | — | — | — | Bal | 14.4 |
| | 12 | 6.9 | 5.8 | 5.7 | 6.2 | 5.1 | — | — | — | — | Bal | 11.9 |
| | 13 | 6.4 | 4.7 | 7.5 | 7.9 | 4.5 | — | — | — | — | Bal | 15.4 |
| | 14 | 6.4 | 4.3 | 8.0 | 8.2 | 4.7 | — | — | — | — | Bal | 16.2 |
| | 15 | 6.1 | 5.1 | 7.2 | 7.3 | 4.3 | — | 5.5 | — | — | Bal | 14.5 |
| | 16 | 7.5 | 4.7 | 7.3 | 7.4 | 4.4 | — | 8.2 | 0.10 | — | Bal | 14.7 |
| | 17 | 6.8 | 5.9 | 8.3 | 2.8 | 4.8 | — | — | — | — | Bal | 11.1 |
| | 18 | 7.0 | 5.9 | 2.5 | 8.1 | 4.8 | — | — | — | — | Bal | 10.6 |
| | 19 | 6.5 | 6.0 | 7.8 | 8.1 | 1.7 | — | — | — | — | Bal | 15.9 |
| | 20 | 7.2 | 6.0 | 3.6 | 3.8 | 6.4 | — | — | — | — | Bal | 7.4 |
| Conventional Alloy | NASAIR100 | 9.1 | 6.0 | 10.5 | 3.4 | 1.0 | 1.2 | — | — | — | Bal | 13.8 |
| | CMSX-2 | 7.7 | 6.0 | 8.2 | 6.2 | 0.6 | 1.0 | 4.6 | — | — | Bal | 14.4 |
| | CMSX-3 | 7.5 | 6.0 | 7.8 | 6.0 | 0.6 | 1.0 | 4.7 | 0.10 | — | Bal | 13.8 |
| | Alloy 444* | 8.0~10.0 | 4.75~5.25 | 11.5~12.5 | — | — | 1.75~2.25 | <0.1 | — | 0.75~1.25 | Bal | 11.5~12.5 |

| Sample Alloy | | Creep Rupture Time (h) | | | Oxidation Loss in Weight (mg/cm²) |
|---|---|---|---|---|---|
| | | 1040° C.-21kgf/mm² | 1040° C.-17kgf/mm² | 1040° C.-14kgf/mm² | |
| Alloy of The Present Invention | 1 | 94 | 700 | 3486 | 1.4 |
| | 2 | 73 | 515 | — | 0.9 |
| | 3 | 88 | 869 | — | 0.8 |
| | 4 | 103 | 727 | — | 0.2 |
| | 5 | 84 | 815 | — | 0.1 |
| | 6 | 88 | 573 | — | −0.1 |
| | 7 | 87 | 783 | — | 0.1 |
| | 8 | 69 | 497 | — | 1.2 |
| Comparative alloy | 11 | 74 | 712 | 1746<br>3107 | 3.4 |
| | 12 | — | 660 | 2482 | 2.4 |

TABLE 1-continued

| | | | | | |
|---|---|---|---|---|---|
| | | | | 2404 | |
| | 13 | 98 | 754 | 1872 | 53.9 |
| | 14 | 74 | 335 | 1080 | 93.3 |
| | 15 | — | 471 | 1317 | 6.7 |
| | 16 | — | 444 | — | 3.3 |
| | 17 | — | 225 | — | — |
| | 18 | — | 193 | — | — |
| | 19 | — | 340 | — | — |
| | 20 | — | 178 | — | — |
| Conventional Alloy | NASAIR100 | 19 | 124 | 574 | 6.5 |
| | CMSX-2 | 31 | 111 | 399 | 4.4 |
| | CMSX-3 | — | 103 | 352 | 2.3 |
| | Alloy 444* | — | — | (1040° C.-12.5kgf/mm$^2$) 300 | — |

*Cited from the U.S. Pat. No. 4,116,723

In the comparative alloys No. 11 to No. 13, the components except cobalt and hafnium are within the range of the chemical compositions of the present inventions. Although the creep rupture strength is high, the oxidation resistance of these comparative alloys is bad because cobalt and hafnium are not included.

In the No. 14 alloy, the creep rupture strength is not very high and oxidation resistance is also bad because the total amount of wolfram and tantalum is more than 16%.

In the No. 15 and No. 16 alloys, oxidation resistance is bad because the cobalt content is more than 4%.

In the No. 17 to No. 20 alloys, the levels of one or more elements of wolfram, tantalum and molybdenum are outside the chemical composition ranges of the alloys of the present invention; the creep rupture strength of these alloys is substantially lower than that of the alloys of the present invention.

The conventional alloys show substantially inferior creep rupture strength and oxidation resistance to the alloys of the present invention. (Incidentally, the data on Alloy 444 are cited from the U.S. Pat. No. 4,116,723.)

In contrast, it is apparent that the alloys of the present invention are excellent in both the creep rupture strength and oxidation resistance.

What is claimed is:

1. A heat resistant single-crystal nickel-base superalloy consisting of by weight 4–9% chromium, 4–6.5% aluminum, 5–8.5% tungsten, 5–8.5% tantalum, the amount of tungsten and tantalum being less than 16%, 3–6% molybdenum, 0.01–0.30% hafnium, 0.01–4%, cobalt, and the balance nickel and incidental elements.

2. A heat resistant single-crystal nickel-base superalloy consisting of by weight 4.5–8.5% chromium, 4–6% aluminum, 5.5–8.2% tungsten, 5.5–8.2% tantalum, the amount of tungsten and tantalum being less than 16%, 3.5–5.5% molybdenum, 0.05–0.25% hafnium, 0.5–3% cobalt, and the balance nickel and incidental elements.

3. A heat resistant single-crystal nickel-base superalloy consisting of by weight approximately 6.4% chromium, approximately 5.1% aluminum, approximately 7.3% tungsten, approximately 7.3% tantalum, approximately 4.3% molybdenum, approximately 0.1% hafnium, approximately 1% cobalt, and the balance nickel and incidental elements.

4. A gas turbine engine blade formed of the alloy of claim 1.

5. A gas turbine engine blade formed of the alloy of claim 3.

6. A heat resistant single-crystal nickel-base superalloy consisting essentially of by weight 4–9% chromium, 4–6.5% aluminum, 5–8.5% tungsten, 5–8.5% tantalum, the amount of tungsten and tantalum being less than 16%, 3–6% molybdenum, 0.01–0.30% hafnium, 0.01–4% cobalt, and the balance nickel.

* * * * *